US005081467A

United States Patent [19]

Homer

[11] Patent Number: 5,081,467

[45] Date of Patent: Jan. 14, 1992

[54] SNAP-IN ANTENNA ELEMENT FOR WINDOW SHADE-TYPE RADAR

[75] Inventor: Peter K. Homer, Langhorne, Pa.

[73] Assignee: Grumman Aerospace Corporation, Bethpage, N.Y.

[21] Appl. No.: 580,578

[22] Filed: Sep. 11, 1990

[51] Int. Cl.[5] ..... H01Q 1/12

[52] U.S. Cl. ..... 343/795; 343/812; 343/846; 343/878

[58] Field of Search ..... 343/795, 793, 878, 879, 343/880, 810, 829, 846, 848, 908, 916, 887, 893, 812, 814, 816, 820

[56] References Cited

U.S. PATENT DOCUMENTS 3,383,693 5/1968 Kahn et al. ..... 343/880

4,573,056 2/1986 Dudome et al. ..... 343/795

*Primary Examiner*—Michael C. Wimer

*Attorney, Agent, or Firm*—Pollock, Vande Sande & Priddy

[57] ABSTRACT

A transmit/receive module and RF elements are constructed as a sub-assembly. Notches are formed along the edges of two parallel spaced antenna planes. These notches engage mating notches formed in the element of the sub-assembly thereby retaining the sub-assembly by "snap-in" action. Conversely, the sub-assembly may be quickly disassembled by unsnapping the engagement of the sub-assembly and antenna plane.

5 Claims, 2 Drawing Sheets

SNAP-IN ANTENNA ELEMENT FOR WINDOW SHADE-TYPE RADAR

RELATED APPLICATIONS

This invention relates to the technology of co-pending U.S. Patent Applications Ser. No. 573,808, 580,583, and 580,584 by the same inventor and assigned to the same assignee.

1. Field of the Invention

The present invention relates to window shade-type radars, and more particularly to a novel radar element-/module assembly.

2. Background of the Invention

The prior art includes a "window shade" deployed space-fed phased array radar antenna which is particularly suited for use in space. The rolled antenna is advantageous because it minimizes storage space aboard a spacecraft. When the spacecraft achieves selected orbit, the antenna is deployed and the "window shade" structure becomes unrolled to a fully expanded operative condition. Such an antenna consists of a low-power RF feed which illuminates a lens aperture membrane. Active transmit/receive (T/R) modules in the aperture membrane receive radar pulses from the ground, amplify them, and perform beam-steering phase shifts so that the signal may be re-transmitted toward a target of interest in space. The reflected energy is received in reverse order, being amplified by the T/R modules then focused back onto the space feed. Radar processors and supporting subsystems are located in a bus at the base of a feed mast. A tensioned three-layer membrane constitutes the aperture and provides a very lightweight, yet sufficiently flat, aperture plane. Array flatness requirements for the space-fed approach are less severe than for corporate-fed approaches by an order of magnitude. The membrane aperture can be rolled up onto a drum resulting in a simple, compact, and repeatable method for deployment/retraction of the antenna.

In a prior art construction, an electronic module is secured to the ground plane of a three-layer antenna membrane. The module has integrally formed drop lines extending from top and bottom surfaces thereof which terminate in dipole antenna elements secured to upper and lower antenna planes of the multi-layer membrane structure.

In the prior art the securement of the elements to the antenna planes has been by means of using fasteners or adhesives. This process is quite time consuming and makes replacement of the elements a difficult task due to the relatively permanent nature of the element securement to the antenna planes.

BRIEF DESCRIPTION OF THE PRESENT INVENTION

The present invention is directed to a novel means for securing the antenna elements to the antenna plane by means of using simple, yet elegant, snap-in assemblies in conjunction with interlocking notches in the thin and rigid sheet material of an antenna plane.

By permitting simple mechanical interlocking between antenna elements and antenna planes, the time and expense of assembly becomes greatly reduced and it becomes a relatively simple matter to replace faulty module/element assemblies.

By virtue of the present invention, a subassembly becomes available which includes a transmit-receive module; and RF elements to be connected to the antenna planes of a three-layer membrane. The sub-assembly is designed so that it can be connected to the ground plane and antenna planes as a unit using "snap-together" elements This sub-assembly approach provides a number of advantages. First, the element-to-module solder connections can be made using a small fixture in an automated or semi-automated process which occurs before final assembly. This greatly simplifies the soldering of the prior art device, which requires hand soldering through the antenna planes during final assembly. The present design allows for the testing of solder joints prior to final integration.

An additional advantage is that the module/element units can be individually tested for continuity and RF performance before integration and calibrated to a common basis. The sub-assemblies therefore retain a common part number until immediately before final integration when each is programmed using a small remote apparatus located adjacent to the final assembly fixture. The only test that now needs to be performed after integration is for continuity of the DC power jumper connections Parts accountability is greatly simplified, as is replacement of units that are damaged during build-up.

An additional consideration concerning the advantages resides in the fact that, since all connections except DC power are made and tested prior to installation, handling of the sub-assemblies during final integration is minimized, as is the amount of time and labor required to install or replace these

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
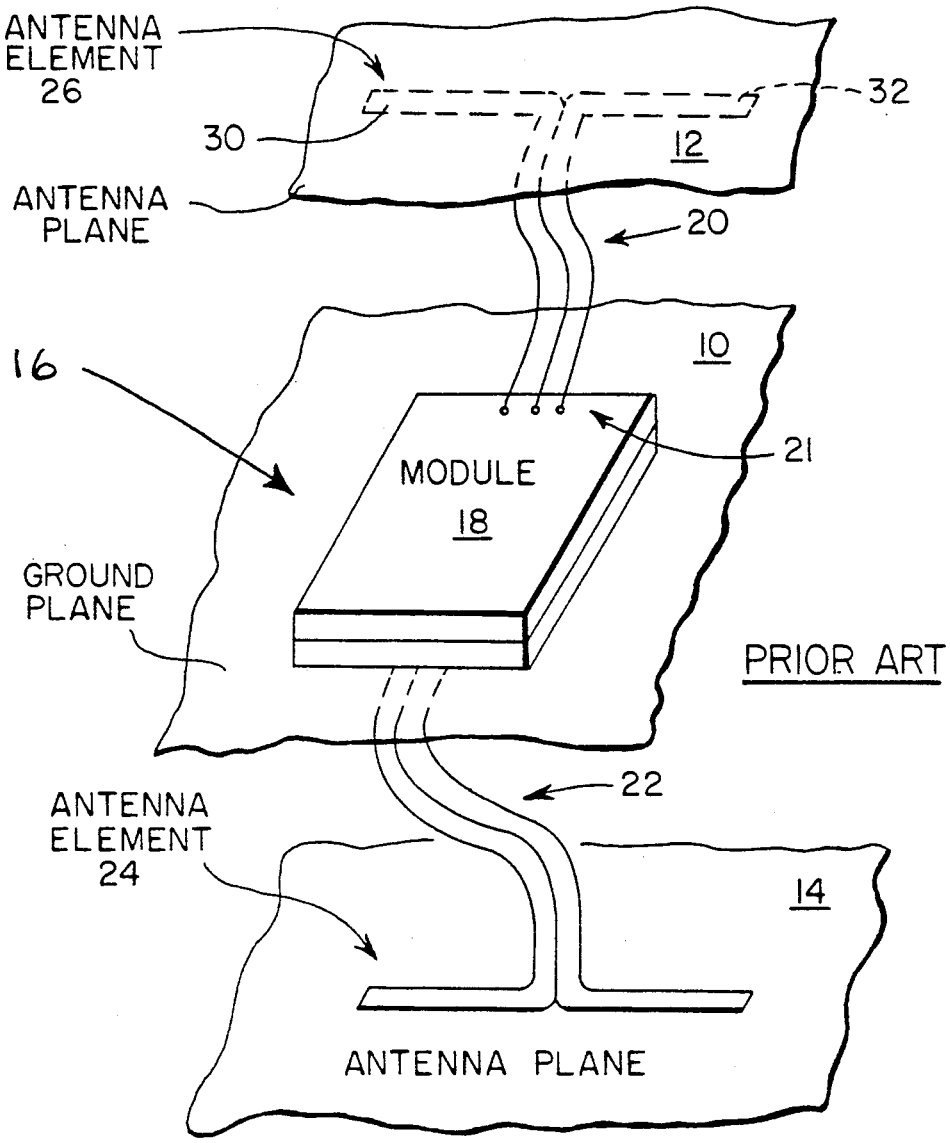
FIG. 1 is a perspective view of a prior art antenna element/module assembly.

In FIG. 1 a basic tri-layer radar membrane 16 is seen to include a median ground plane 10 layered between upper and lower antenna planes 12 and 14. An electronic module 18 is seen to be appropriately mounted to the ground plane 10.

Integrally formed with the casing of module 18 are fine antenna drop lines 20 and 22 which connect the prior art processing circuitry within the module to antenna elements 24 and 26. As will be seen from the upper element 26, it is comprised of a simple dipole having oppositely directed wires 30 and 32.

Figure 2:
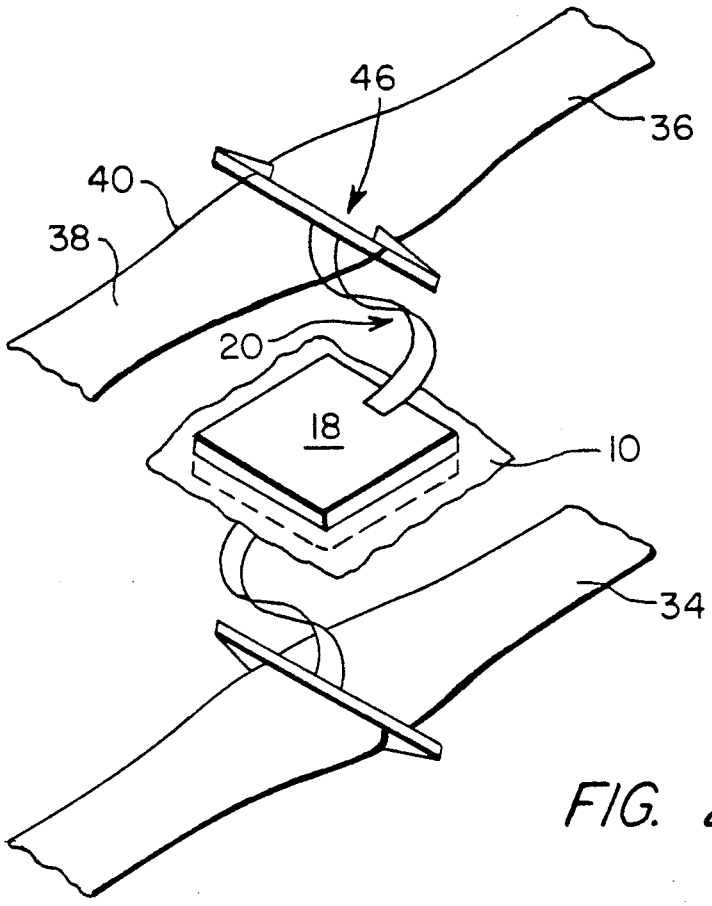
FIG. 2 is a perspective view similar to FIG. 1 but showing the improvement constituting the present invention.

FIG. 2 illustrates the improvement of the present invention, notably in the construction of the antenna elements. In accordance with the present invention, the upper antenna element 46 is also a dipole integral with drop line 20. The element may consist of a plastic substrate, from material such as KAPTON, having the dipole wires embedded therein.

Figure 3:
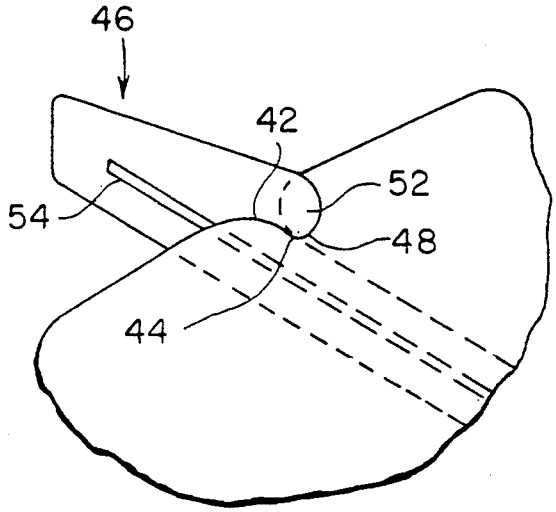
FIG. 3 is a partial detailed perspective view of the mounting of an antenna element to an antenna plane.

With continued reference to FIG. 2, it will be noticed that the shapes for the antenna planes 34 and 36 have a particular edge contour as compared with the prior art where generally rectangular strips are employed The contour of the antenna plane includes narrowed sections 38 on either side of an enlarged central section 40. Mid-point along the enlarged section 40 is an inwardly tapering notch 42, terminating inwardly at point 44, more clearly shown in FIG. 3. The purpose of this notch is to engage a mating notch 48 formed in the element 46, as indicated in FIG. 3.

Figure 4:
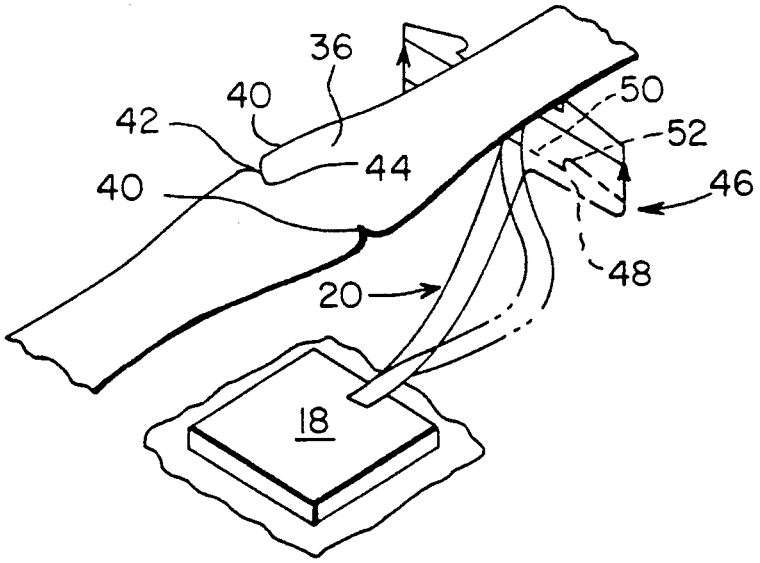
FIG. 4 is a perspective view illustrating the initial placement of an antenna element on an antenna plane.

In FIG. 4 the dotted element 46 is more clearly exposed and seen to include a central straight section 50 terminating in flared outward end sections 52 The notch 48 is defined between each of the flared end sections and the straight section. In FIG. 4 the assembly of an element onto an antenna plane is illustrated. As is shown, the element is moved from the dotted position against the narrow section 38 of the antenna plane until the straight section 50 contacts the underside of the antenna plane. Then, the element is moved toward the enlarged section 40. Because of the thinness of the antenna plane, it will bulge slightly until the notches 42 in the antenna plane interlock with the notches 48 in the element. At this point, the buckling will disappear and the element will be retained by the antenna plane sufficiently to permit correct operation of a resulting radar assembly. Of course, should the disassembly of module and receiver be necessary, this is easily accomplished by reversing the mounting procedure just discussed.

Thus, by virtue of the preceding description, it will be appreciated that the invention offers an element-/module sub-assembly which is quickly mounted to the membranes of an antenna and can likewise be quickly removed for replacement.

It should be understood that the invention is not limited to the exact details of construction shown and described herein for obvious modifications will occur to persons skilled in the art.

I claim:

1. A snap-on antenna element assembly comprising:

an antenna plane in the form of a strip having notches transversely formed along its edges;

an antenna element formed of sheet material and having notches transversely formed therein for removably engaging the antenna plane notches;

a drop line integrally connected at one end thereof to the element, an opposite end of the drop line being connected to electronic circuitry;

wherein the antenna plane strip includes narrow sections joined at a median enlarged section in which the notches are formed.

2. The assembly set forth in claim 1 wherein the antenna element includes:

a straight central section for contacting the surface of the antenna plane strip; and enlarged portions at opposite sides of the straight central section, wherein the notches are formed inwardly of the enlarged portions.

3. An antenna element assembly for a three-layer radar membrane including two spaced antenna planes and an interposing ground plane, the assembly comprising:

an electronic module fastened to the ground plate;

two drop lines connected at first ends thereof to the module;

each antenna plane being formed as a strip having notches transversely formed along its edges;

two separate antenna elements each formed of sheet material and having notches transversely formed therein for removably engaging the antenna plane notches;

wherein second ends of the drop lines are integrally connected to a respective antenna element.

4. The assembly set forth in claim 3 wherein each antenna plane strip includes narrow sections joined at a median enlarged section in which the notches are formed.

5. The assembly set forth in claim 4 wherein each antenna element includes a straight central section for contacting the surface of the antenna plane strip; and enlarged portions at opposite sides of the straight central section, wherein the notches are formed inwardly of the enlarged portions.

* * * * *

UNITED STATES PATENT AND TRADEMARK OFFICE

CERTIFICATE OF CORRECTION

PATENT NO. : 5,081,467

DATED : January 14, 1992

INVENTOR(S) : Peter K. Homer

It is certified that error appears in the above-identified patent and that said Letters Patent is hereby corrected as shown below:

Column 2, line 31, after "these" insert --units.--.

Column 3, line 4, after "employed" insert --.--.

Column 3, line 14, after "52" insert --.--.

Column 4, line 23, change "plate" to --plane--.

Signed and Sealed this

Twentieth Day of April, 1993

*Attest:*

MICHAEL K. KIRK

*Attesting Officer*

*Acting Commissioner of Patents and Trademarks*